US005957315A

United States Patent [19]

Kaitsuka

[11] Patent Number: 5,957,315

[45] Date of Patent: Sep. 28, 1999

[54] PLASTIC CONTAINER CLOSURE WITH TAMPER EVIDENT PROPERTIES

[75] Inventor: Yoshihiro Kaitsuka, Hiratsuka, Japan

[73] Assignee: Japan Crown Cork Co., Ltd., Tokyo, Japan

[21] Appl. No.: 09/123,408

[22] Filed: Jul. 28, 1998

Related U.S. Application Data

[63] Continuation of application No. PCT/JP97/00004, Dec. 17, 1997.

[30] Foreign Application Priority Data

Dec. 17, 1996 [JP] Japan ..... 8-336188

[51] Int. Cl.[6] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,488,655 | 12/1984 | Itsubo et al. . | |
| 4,565,295 | 1/1986 | Mori et al. . | |
| 4,744,479 | 5/1988 | Schottli | 215/252 |
| 5,080,246 | 1/1992 | Hayes | 215/252 |
| 5,289,931 | 3/1994 | Doi . | |
| 5,673,809 | 10/1997 | Ohmi et al. | 215/252 |

FOREIGN PATENT DOCUMENTS

| | | |
|---|---|---|
| 49-100949 | 8/1974 | Japan . |
| UM-141950/1973 | 8/1974 | Japan . |
| 58-32105 | 7/1983 | Japan . |
| 62-18421 | 4/1987 | Japan . |
| 62-159351 | 10/1987 | Japan . |
| UM-43541/1986 | 10/1987 | Japan . |
| 4-215965 | 8/1992 | Japan . |
| 4-311461 | 11/1992 | Japan . |
| 6-54544 | 7/1994 | Japan . |
| 8-80957 | 3/1996 | Japan . |
| 1454091 | 10/1976 | United Kingdom . |
| WO 98/26991 | 6/1998 | WIPO . |

*Primary Examiner*—Stephen K. Cronin

*Attorney, Agent, or Firm*—Smith, Gambrell & Russell, LLP; Beveridge, DeGrandi, Weilacher & Young Intellectual Property Group

[57] ABSTRACT

A plastic container closure having tamper evident properties of a type in which axial breakage means disposed in a tamper evident bottom portion is constituted from a slit continuously extending from the upper end of the tamper evident bottom portion substantially to its lower end. A first high strength bridging portion is disposed on one circumferential side of an upper end of the axial breakage means, while a second high strength bridging portion is disposed on the other circumferential side of the upper end of the axial breakage means, whereby when the container closure is mounted on a mouth-and-neck portion of a container, the tamper evident bottom portion is prevented from being enlarged at a site where its axial breakage means exists.

14 Claims, 5 Drawing Sheets

PLASTIC CONTAINER CLOSURE WITH TAMPER EVIDENT PROPERTIES

This application is a continuation of PCT/JP97/00004 filed Dec. 17, 1997.

TECHNICAL FIELD

This invention relates to a plastic container closure to be applied to a container for containing a beverage or the like, the container having a mouth-and-neck portion on whose outer peripheral surface an external thread and an engaging jaw portion positioned below the external thread are formed. More specifically, the invention relates to a plastic container closure having tamper evident properties (the properties that when the container closure is manipulated for unjust purposes, the traces of the manipulation are left).

BACKGROUND ART

Usually, a glass or plastic container for a soft drink or the like has a mouth-and-neck portion on whose outer peripheral surface an external thread and an engaging jaw portion positioned below the external thread are formed. As is well known, a plastic container closure having tamper evident properties of the type disclosed, for example, in Japanese Patent Publication Nos. 32103/83 and 18421/87, Japanese Unexamined Patent Publication No. 311461/92, Japanese Unexamined Utility Model Publication No. 54544/94 and Japanese Unexamined Patent Publication No. 80957/96 has found widespread use for such a container. The container closure has a circular top panel wall, and a skirt wall extending downwardly from the top panel wall. The skirt wall has formed therein a circumferentially extending circumferential breakage means, which divides the skirt wall into a main portion above the circumferential breakage means, and a tamper evident bottom portion below the circumferential breakage means. The main portion of the skirt wall has formed on its inner peripheral surface an internal thread collaborating with the external thread formed in the mouth-and-neck portion of the container. The tamper evident bottom portion has formed on its inner peripheral surface an engaging means collaborating with the engaging jaw portion formed in the mouth-and-neck portion of the container. The circumferential breakage means includes a plurality of bridging portions disposed at circumferentially spaced positions and connecting the tamper evident bottom portion to the main portion of the skirt wall. One of the plurality of bridging portions is a high strength bridging portion having a large cross-sectional area. In the tamper evident bottom portion, axial breakage means is formed. The axial breakage means is constituted from a score formed by reducing the thickness of the material, or a slit including a discontinuous portion (a groove formed by either completely cutting the material in its thickness direction, or causing the material not to be present in the entire thickness direction during molding).

To seal the mouth-and-neck portion of the container by mounting the container closure thereon, the container closure is fitted on the mouth-and-neck portion, and turned in a closing direction to screw the internal thread of the container closure onto the external thread of the mouth-and-neck portion. As the screwing together of the external thread and the internal thread proceeds, the container closure is brought downward. The engaging means of the container closure is elastically passed over the engaging jaw portion of the mouth-and-neck portion and engaged with the surface below the engaging jaw portion. To unseal the mouth-and-neck portion of the container, the container is turned in an opening direction. As a result, the internal thread of the container closure is moved along the external thread of the mouth-and-neck portion, whereupon the screwing together of the external thread and the internal thread is released. Thus, the container closure is brought upward in accordance with turning in the opening direction. However, the engaging means formed in the tamper evident bottom portion remains engaged with the engaging jaw portion of the mouth-and-neck portion. Hence, the tamper evident bottom portion is inhibited from ascending. Because of this inhibition, stress is generated in the circumferential breakage means, whereby the bridging portions in the circumferential breakage means are broken, except for the one high strength bridging portion. Furthermore, occurrence of the following behavior has been contemplated: The score or the discontinuous portion of the slit in the axial breakage means formed in the tamper evident bottom portion will be broken. Thus, the tamper evident bottom portion will be spread in the form of a band, whereby the engaging means will be disengaged from the engaging jaw portion. Then, the entire container closure will be moved upward in accordance with the turning in the opening direction, and removed from the mouth-and-neck portion.

According to the experience that we, the inventors, have, the conventional container closure described above poses the following problem: In unsealing the mouth-and-neck portion of the container, it has been intended that the score or the discontinuous portion of the slit in the axial breakage means formed in the tamper evident bottom portion will be broken, so that the tamper evident bottom portion will be spread in the form of a band. However, the one high strength bridging portion in the circumferential breakage means may be broken instead of the breakage of the score or the discontinuous portion of the slit in the axial breakage means. As a result, the score or the discontinuous portion of the slit may remain unbroken. This may result in the event that the tamper evident bottom portion in an endless annular shape is completely separated from the main portion of the skirt wall, and this endless annular shaped tamper evident bottom portion remains on the mouth-and-neck portion of the container, while the other portions of the container closure are removed from the mouth-and-neck portion. If this event happens, the task of cutting off the endless annular shaped tamper evident bottom portion by a suitable cutting tool to remove it from the mouth-and-neck portion of the container in a band-like spread form will have to be performed separately, from the point of view of material-wise collection of wastes or for the purpose of container recycling.

To solve the foregoing problem with the conventional container closure, it is intended to constitute the axial breakage means, disposed in the tamper evident bottom portion, from a slit continuously extending from the upper end of the tamper evident bottom portion substantially to its lower end. By so doing, when the mouth-and-neck portion of the container is to be unsealed, the bridging portions in the circumferential breakage means are broken, except for the one high strength bridging portion, whereupon the tamper evident bottom portion is necessarily spread in a band form. Thus, the entire container closure is removed from the mouth-and-neck portion of the container fully reliably. However, constituting the axial breakage means, disposed in the tamper evident bottom portion, from a slit continuously extending from the upper end of the tamper evident bottom portion substantially to its lower end tends to cause the following unacceptable event: When the container closure is mounted on the mouth-and-neck portion of the container, especially when the engaging means of the container closure elastically passes over the engaging jaw portion of the mouth-and-neck portion, the tamper evident bottom portion is enlarged at the site where its axial breakage means exists. This causes breakage of at least some of the plurality of bridging portions in the circumferential breakage means.

DISCLOSURE OF THE INVENTION

It is a principal object of the present invention, therefore, to provide a novel and improved plastic container closure in which an axial breakage means disposed in a tamper evident bottom portion is constituted from a slit continuously extending from the upper end of the tamper evident bottom portion substantially to its lower end, so that when bridging portions in a circumferential breakage means are broken, except for one high strength bridging portion, the tamper evident bottom portion is necessarily spread in a band form; but which sufficiently reliably prevents the situation that when the container closure is mounted on a mouth-and-neck portion of a container, the tamper evident bottom portion is enlarged at the site where its axial breakage means exists, thereby causing breakage of at least some of the plurality of bridging portions in the circumferential breakage means.

To attain this principal object, according to the present invention, two of the plurality of bridging portions are made high strength bridging portions with a large cross-sectional area, the two high strength bridging portions are disposed on both sides of the upper end of the axial breakage means constituted from the slit extending from the upper end of the tamper evident bottom portion substantially to its lower end, and one of the high strength bridging portions extends in one circumferential direction from the upper end, or one end close thereto, of the axial breakage means, while the other high strength bridging portion extends in the opposite circumferential direction from the upper end, or one end close thereto, of the axial breakage means.

That is, as a plastic container closure for attaining the aforesaid principal object, the present invention provides a plastic container closure having tamper evident properties which is to be applied to a container having a mouth-and-neck portion on whose outer peripheral surface an external thread and an engaging jaw portion positioned below the external thread are formed, the plastic container closure having a top panel wall and a skirt wall extending downwardly from the top panel wall; the skirt wall having formed therein a circumferentially extending circumferential breakage means, the skirt wall being divided into a main portion above the circumferential breakage means, and a tamper evident bottom portion below the circumferential breakage means; the main portion of the skirt wall having formed on its inner peripheral surface an internal thread collaborating with the external thread of the mouth-and-neck portion; the tamper evident bottom portion having formed on its inner peripheral surface an engaging means collaborating with the engaging jaw portion of the mouth-and-neck portion; the circumferential breakage means including a plurality of bridging portions disposed at circumferentially spaced positions and connecting the tamper evident bottom portion to the main portion of the skirt wall; one of the bridging portions being a first high strength bridging portion having a large cross-sectional area; and the tamper evident bottom portion having disposed therein an axial breakage means; wherein the axial breakage means is constituted from a slit continuously extending from the upper end of the tamper evident bottom portion substantially to its lower end; the plurality of bridging portions include a second high strength bridging portion having a large cross-sectional area in addition to the first high strength bridging portion; the first high strength bridging portion and the second high strength bridging portion are disposed on both sides of the axial breakage means when viewed in the circumferential direction; and the first high strength bridging portion extends in one circumferential direction from the upper end, or one end close thereto, of the axial breakage means, while the second high strength bridging portion extends in the opposite circumferential direction from the upper end, or one end close thereto, of the axial breakage means;

the internal thread is screwed onto the external thread and the engaging means is engaged with the engaging jaw portion, whereby the plastic container closure is mounted on the mouth-and-neck portion; and when the screwing together of the internal thread and the external thread is released to remove the plastic container closure from the mouth-and-neck portion, at least one of the first high strength bridging portion and the second high strength bridging portion is broken.

Preferably, the cross-sectional area of the first high strength bridging portion is larger than the cross-sectional area of the second high strength bridging portion, and when the screwing together of the internal thread and the external thread is released to remove the plastic container closure from the mouth-and-neck portion, the second high strength bridging portion is broken, while the first high strength bridging portion remains unbroken, the tamper evident bottom portion is spread in a band form with the engaging means being disengaged from the engaging jaw portion, and the entire container closure including the tamper evident bottom portion is removed from the mouth-and-neck portion. It is preferred that the cross-sectional area of the first high strength bridging portion is 1.50 to 4.50 $mm^2$, while the cross-sectional area of the second high strength bridging portion is 0.80 to 2.20 $mm^2$. Preferably, when viewed in a direction in which the container closure is turned for releasing the screwing together of the internal thread and the external thread to remove the container closure from the mouth-and-neck portion, the first high strength bridging portion is located ahead of the axial breakage means, while the second high strength bridging portion is located behind the axial breakage means. It is also preferred that the one end of the first high strength bridging portion and the one end of the second high strength bridging portion are positioned at a distance of 1.00 to 3.00 mm from the upper end of the axial breakage means. In a preferred embodiment, the tamper evident bottom portion is provided with a thin-walled curl extending from the lower end thereof, and the slit constituting the axial breakage means extends only partly, or does not extend at all, to the thin-walled curl.

BEST MODE FOR CARRYING OUT THE INVENTION

Preferred embodiments of a plastic container closure constructed in accordance with the present invention will now be described in further detail with reference to the accompanying drawings.

Figure 1:
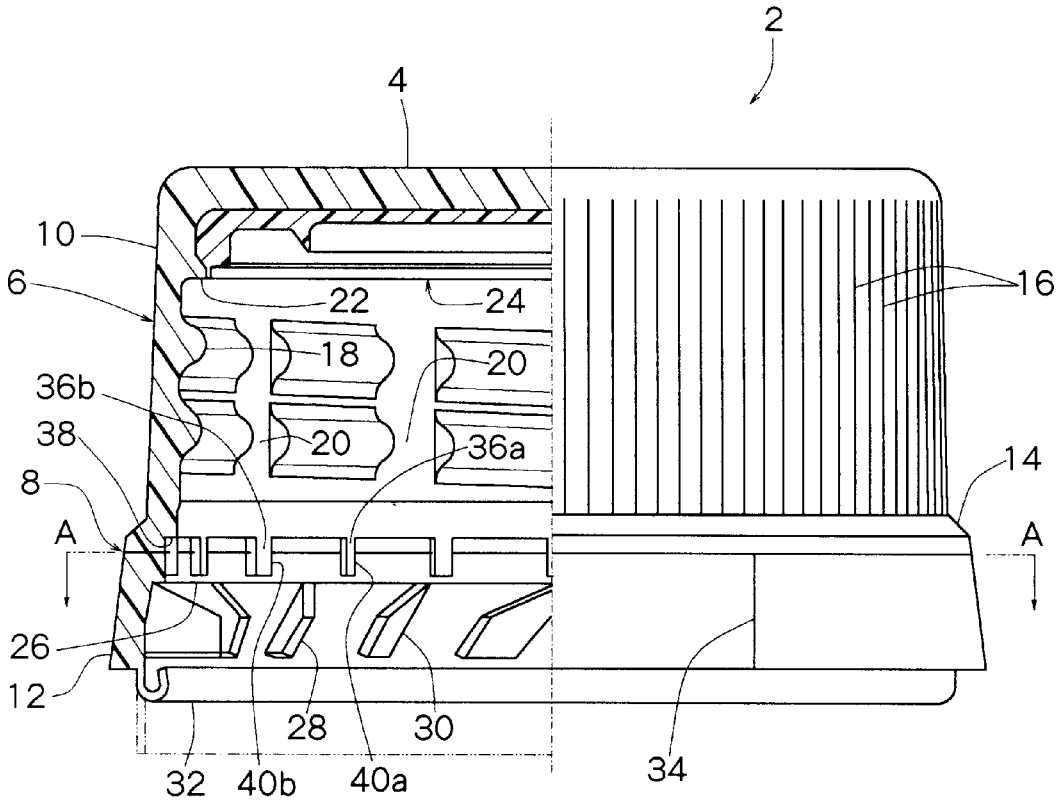
FIG. 1 is a partly sectional front view of a preferred embodiment of a container closure constructed in accordance with the present invention.

FIG. 1 shows a preferred embodiment of a plastic container closure constructed in accordance with the present invention. A container closure designated entirely as the numeral 2, which may be formed from a suitable plastic material such as polypropylene or rigid polyethylene, has a circular top panel wall 4 and a nearly cylindrical skirt wall 6 extending downwardly from the peripheral edge of the top panel wall 4. The skirt wall 6 has formed therein a circumferential breakage means 8 (the circumferential breakage means 8 will be described later on in more detail). The skirt wall 6 is divided into a main portion 10 above the circumferential breakage means 8, and a tamper evident bottom portion 12 below the circumferential breakage means 8.

Near a lower end part of the outer peripheral surface of the main portion 10 of the skirt wall 6, a truncated conical portion 14 is formed which has an outer diameter progressively increasing downward. The lower end part of the main portion 10 of the skirt wall 4, i.e., the part below the truncated conical portion 14, and the outer peripheral surface of the tamper evident bottom portion 12 continuing therefrom are also formed in a truncated conical shape whose outer diameter progressively increases, although slightly, in the downward direction. On the outer peripheral surface of the main portion 10 and above the truncated conical portion 14, knurls 16 are formed for preventing the slippage of fingers placed thereon. On the inner peripheral surface of the main portion 10, an internal thread 18 is formed. In the internal thread 18, axially extending notches 20 are formed at circumferentially spaced positions. These notches 20 is constitute an air passage for use when a mouth-and-neck portion of a container is unsealed. On the inner peripheral surface of the main portion 10, an annular protrusion 22 is formed in an upper end part of this inner peripheral surface. In a space defined by the annular protrusion 22 and the inner surface of the top panel wall 4, a sealing liner 24 is disposed which is formed separately from the body of the container closure 2. The sealing liner 24 can advantageously be molded by feeding a softened, molten plastic material onto the inner surface of the top panel wall 4, and compressing this plastic material by a pressing tool. Preferably, the plastic material for the sealing liner 24 is a relatively soft plastic material such as flexible polyethylene.

In an upper part of the inner peripheral surface of the tamper evident bottom portion 12, a downwardly directed annular shoulder surface 26 is formed. Below the annular shoulder surface 26, a plurality of circumferentially equally spaced flap pieces 28 are formed on the inner peripheral surface of the tamper evident bottom portion 12. As will become clear from a description to be given later on, these flap pieces 28 constitute engaging means to be engaged with an engaging jaw portion formed in the mouth-and-neck portion of the container. Each of the flap pieces 28 protrudes radially inwardly in an inclined manner from a base edge 30 connected to the inner peripheral surface of the tamper evident bottom portion 12. The direction of inclination of each flap piece 28 is opposite to the closing turning direction of the container closure during the mounting of the container closure 2 on the mouth-and-neck portion of the container, i.e., opposite to the clockwise direction when viewed from above in FIG. 1. The base edge 30 of each of the flap pieces 28, itself, also extends downwardly in an inclined manner in the direction opposite to the above closing turning direction of the container closure 2. The lower end of the tamper evident bottom portion 12 is provided with a thin-walled curl 32 extending arcuately in a radially inward direction.

Figure 2:
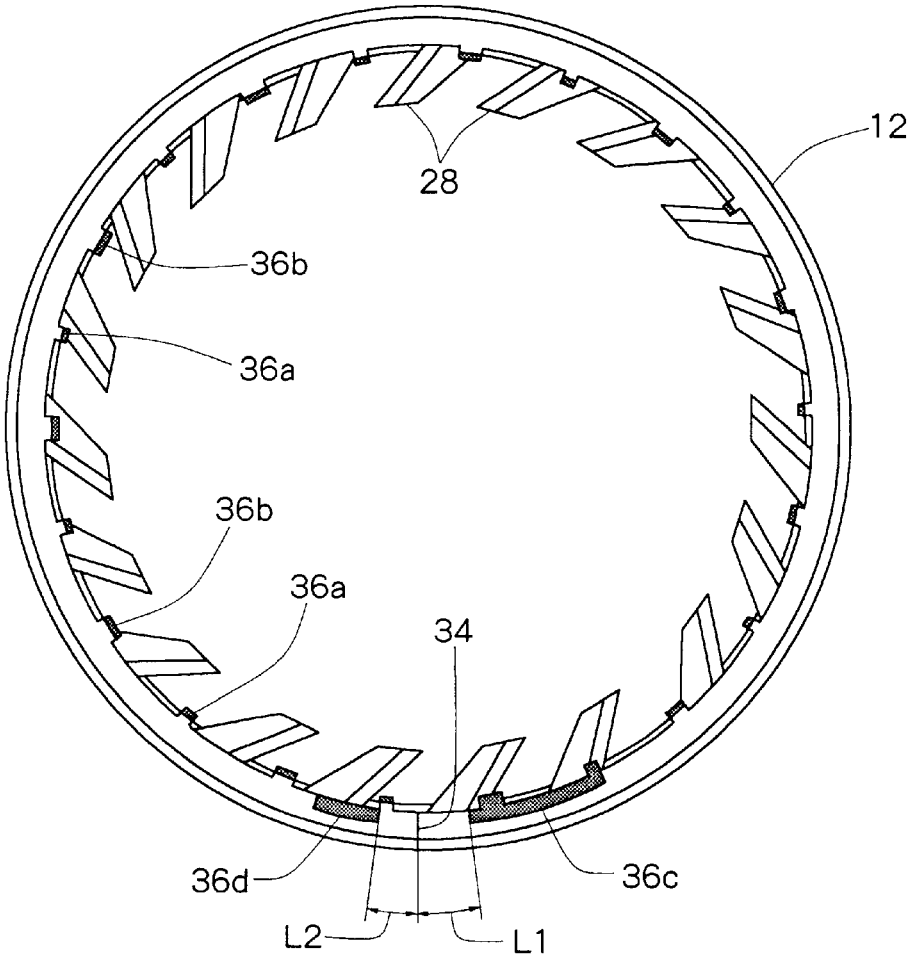
FIG. 2 is a cross-sectional view taken along line A—A of FIG. 1.
Figure 3:
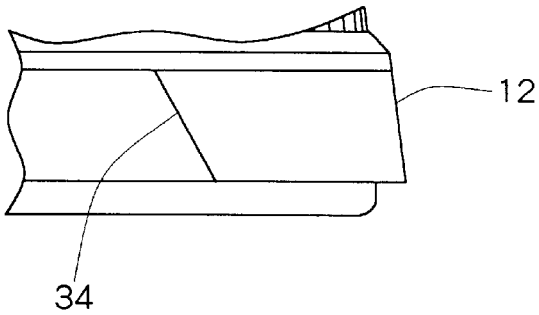
FIG. 3 is a partial front view showing a modified example of an axial breakage means.

With reference to FIG. 2 along with FIG. 1, axial breakage means 34 is formed in the tamper evident bottom portion 12. It is important that the axial breakage means 34 be constituted from a slit continuously extending from the upper end of the tamper evident bottom portion 12 substantially to its lower end. In the illustrated embodiment, the slit constituting the axial breakage means 34 continuously extends from the upper end of the tamper evident bottom portion 12 downwardly to the upper end of the thin-walled curl 32. However, this slit does not extend at all, or extends only partly, into the thin-walled curl 32 (in accordance with a cutting error during a procedure for forming the axial breakage means 34 to be described later on, the slit may be in such a form as to partly extend, or as not to extend at all, into the thin-walled curl 32). If desired, the slit constituting the axial breakage means 34 may be caused to extend to the front end of the thin-walled curl 32. Preferably, the slit constituting the axial breakage means 34 does not intersect the base edge 30 of the flap piece 28 formed on the inner peripheral surface of the tamper evident bottom portion 12, but is positioned between the flap pieces 28. If desired, instead of making the slit constituting the axial breakage means 34 extend substantially vertically (i.e., substantially parallel to the central axis), it is possible to incline this slit somewhat to make it extend substantially parallel to the base edge 30 of the flap piece 28 as illustrated, for example, in FIG. 3.

As will be clearly understood by reference to FIG. 2, the aforementioned circumferential breakage means 8 includes a plurality of bridging portions 36*a*, 36*b*, 36*c* and 36*d* disposed at circumferential intervals. This cross-sectional view where the circumferential breakage means 8 is disposed shows that in the region other than the bridging portions 36*a*, 36*b*, 36*c* and 36d, the main portion 10 of the skirt wall 6 and the tamper evident bottom portion 12 are separated from each other, preferably, by cutting. Thus, the tamper evident bottom portion 12 is connected to the main portion 10 via the bridging portions 36*a*, 36*b*, 36*c* and 36*d*. The bridging portions 36*a* are arranged in plural numbers with equal spacing in the circumferential direction (except in the region where a first high strength bridging portion 36*c* to be described later on is disposed), and have substantially the same cross-sectional shape. The bridging portions 36*b* are also arranged in plural numbers with equal spacing in the circumferential direction (except in the region where the first high strength bridging portion 36*c* to be described later on is disposed), and have substantially the same cross-sectional shape. The bridging portions 36*a* and the bridging portions 36*b* are arranged in the same number, and each of the bridging portions 36*b* is positioned midway between the adjacent bridging potions 36*a*. The cross-sectional area of each of the bridging portions 36*a* is sufficiently small. The cross-sectional area of each of the bridging portions 36*b* is also slightly larger than the cross-sectional area of the bridging portion 356*a*, but is sufficiently small. The bridging portions 36*a* and 36*b* can be broken sufficiently easily. The bridging portion 36*c* is a first high strength bridging portion with a large cross-sectional area, while the bridging portion 36*d* is a second high strength bridging portion with a relatively large cross-sectional area. In FIG. 2, the first high strength bridging portion 36*c* extends counterclockwise from one end positioned at a distance L1 in the counterclockwise direction (one circumferential direction) from the upper end of the axial breakage means 34. Whereas the second high strength bridging portion 36*d* extends clockwise from one end positioned at a distance L2 in the clockwise direction (the opposite circumferential direction) from the upper end of the axial breakage means 34. To cause behaviors (to be described later on) to the container closure 2 reliably when mounting the container closure 2 on the mouth-and-neck portion of the container and removing the container closure 2 from the mouth-and-neck portion of the container, it is preferred that the cross-sectional area A1 of the first high strength bridging portion 36*c* be about 1.50 to 4.50 $mm^2$, while the cross-sectional area A2 of the second high strength bridging portion 36*d* be smaller than the cross-sectional area of the first high strength bridging portion 36*c* (A2<A1) and be about 0.80 to 2.20 $mm^2$. The distances L1 and L2 are preferably about 1.00 to 3.00 mm.

An example of the procedure for producing the above-described container closure 2 will be described. First, the body of the container closure 2 (i.e., the portion excluding the sealing liner 24) is molded from a suitable plastic material by compression molding or injection molding. In the molded container closure body, the circumferential breakage means 8 has not been formed, and at the site of the circumferential breakage means 8, the main portion 10 of the skirt wall 6 and the tamper evident bottom portion 12 are connected together in the entire region of the cross section. The thin-walled curl 32 has not been curled, but is caused to extend substantially vertically downwardly as indicated by a two-dot chain line in FIG. 1.

Then, the circumferential breakage means 8 is formed by performing the following cutting step: As will be clearly understood by reference to FIG. 1, a downwardly directed annular shoulder surface 38 slightly above the aforementioned annular shoulder surface 26 is also formed on the inner peripheral surface of the skirt wall 6. From the annular shoulder surface 38, protrusions 40*a* and 40*b* extending downwardly to a position slightly above the annular shoulder surface 26 are formed. The protrusions 40*a* are arranged in plural numbers with equal spacing in the circumferential direction, and have substantially the same shape. The protrusions 40*b* are also arranged with equal spacing in the circumferential direction, and have substantially the same shape. The protrusions 40*a* and 40*b* are arranged in the same number, and each of the protrusions 40*b* is positioned midway between the adjacent protrusions 40*a*. The protrusions 40*a* (excluding the protrusion 40*a* positioned in the region where the first high strength bridging portion 36*c* lies) define the bridging portions 36*a*, while the protrusions 40*b* (excluding the protrusion 40*b* positioned in the region where the first high strength bridging portion 36*c* lies) define the bridging portions 36*b*. Thus, the cross-sectional shape of the protrusion 40*a* corresponds to the cross-sectional shape of the bridging portion 36*a*, while the cross-sectional shape of the protrusion 40*b* corresponds to the cross-sectional shape of the bridging portion 36*b*. In the cutting step for forming the circumferential breakage means 8, the first task is to cut the skirt wall 6 gradually in the circumferential direction from its outer peripheral surface as far as its inner peripheral surface, while leaving intact an angular region where the first high strength bridging portion 36*c* and the second high strength bridging portion 36*d* are present. A cutting blade for use in such cutting substantially does not act on the protrusions 40*a* and 40*b*. For convenience of cutting, radially outward portions of the protrusions 40*a* and 40*b* can be partially cut, while main portions of the protrusions 40*a* and 40*b* are not cut, but retained, whereby the bridging portions 36*a* and 36*b* are formed. Then, in the angular region where the first high strength bridging portion 36*c* and the second high strength bridging portion 36*d* are present, the skirt wall 6 is partly cut by applying a cutting blade there from the outer peripheral surface of the skirt wall 6 to a predetermined depth in the thickness direction of the skirt wall 6 (in the illustrated embodiment, to a depth about a half of the thickness). In this manner, the first high strength bridging portion 36*c* and the second high strength bridging portion 36*d* are produced. In the illustrated embodiment, as clearly understood by reference to FIG. 2, one protrusion 40*a* and one protrusion 40*b* define part of the first high strength bridging portion 36*c*. Then, an axially extending cutting blade is operated in the tamper evident bottom portion 12 to axially cut the tamper evident bottom portion 12 in its entire thickness direction as far as its substantially lower end, thereby forming a slit constituting the axial breakage means 34.

After the above cutting step, a hot curling tool is applied to the thin-walled portion extending substantially vertically without being curled, whereby the thin-walled portion is curled in a shape indicated by a solid line in FIG. 1 to form the thin-walled curl 34. Then, the aforementioned molding step using a pressing tool is carried out to form a sealing liner, thus completing the container closure 2.

Figure 4:
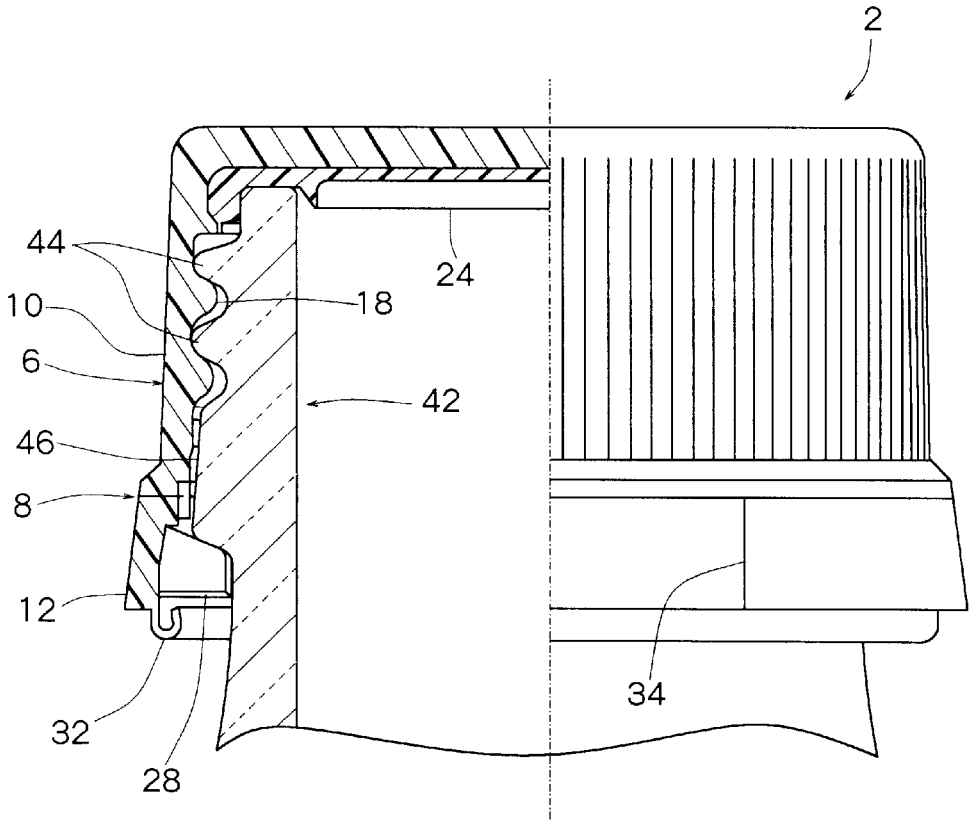
FIG. 4 is a front view showing, in a partly sectional manner, a state in which the container closure illustrated in FIG. 1 is mounted on a mouth-and-neck portion of a container.

FIG. 4 shows a state in which the container closure 2 is mounted, as required, on a mouth-and-neck portion 42 of a container. The mouth-and-neck portion 42 of the container, which may be formed from glass or a suitable plastic material such as polyethylene terephthalate, is cylindrical as a whole. On its outer peripheral surface, an external thread 44 and an annular engaging jaw portion 46 positioned below the external thread 44 are formed. After a suitable product such as a soft drink is filled into the container, the container closure 2 is mounted on the mouth-and-neck portion 42. At this time, the container closure 2 is fitted on the mouth-and-neck portion 42, and turned in a closing turning direction, i.e., clockwise when viewed from above in FIG. 4. As a result, the internal thread 18 in the container closure 2 is screwed around the external thread 44 of the mouth-and-neck portion 42, whereupon the container closure 2 is lowered in accordance with turning. The flap pieces 28 formed in the tamper evident bottom portion 12 of the container closure 2 are elastically deformed and passed over the engaging jaw portion 46 of the mouth-and-neck portion 42. Then, the flap pieces 28 are elastically returned to the original form and engaged with the engaging jaw portion 46. During passage of the flap pieces 28 over the engaging jaw portion 46, a radially outward force is exerted on the tamper evident bottom portion 12. Owing to this force, the slit constituting the axial breakage means 34 in the tamper evident bottom portion 12 is to be enlarged. In the container closure 2 constructed in accordance with the present invention, however, the first high strength bridging portion 36*c* (FIG. 2) is present on one side of the slit, and the second high strength bridging portion 36*d* (FIG. 2) is present on the other side of the slit, when viewed in the circumferential direction. The holding action of the first high strength bridging portion 36*c* and the second high strength bridging portion 36*d* prevents the undesirable enlargement of the slit fully reliably. Thus, the breakage of the bridging portions 36*a* and 36*b* (Fig. 2) during mounting of the container closure 2 is prevented fully reliably. The sealing liner 24 disposed on the inner surface of the top panel wall 4 in the container closure 2 is brought into intimate contact with the top surface of the mouth-and-neck portion 42, whereby the mouth-and-neck portion 42 is sealed.

To unseal the mouth-and-neck portion 42 of the container, the container closure 2 is turned in an opening turning direction, i.e., counterclockwise when viewed from above in FIG. 4. By so doing, the internal thread 18 formed in the main portion 10 of the skirt wall 6 in the container closure 2 is moved along the external thread 44 formed in the mouth-and-neck portion 42 of the container, so that the container closure 2 is raised in accordance with the turning. In the tamper evident bottom portion 12 of the container closure 2, however, the flap pieces 28 formed on its inner peripheral surface are engaged with the engaging jaw portion 46 of the mouth-and-neck portion 42, whereby the tamper evident bottom portion 12 is inhibited from moving upward. Thus, a considerable stress is generated in the bridging portions 36*a*, 36*b*, 36*c* and 36*d* (FIG. 2) in the circumferential breakage means 8 disposed in the skirt wall 6. This stress breaks the bridging portions 36*a* and 36*b* with a sufficiently small cross-sectional area. The second high strength bridging portion 36*d* is also broken. Furthermore, the thin-walled curl 32 provided in the tamper evident bottom portion 12 is broken along an extension of the slit formed in the tamper evident bottom portion 12 (the slit constituting the axial breakage means 34). Such breakage of the thin-walled curl 32 is achieved fully easily and reliably because of its very thin wall. Once the above-described breakage is carried out, the tamper evident bottom portion 12, which keeps connected to the main portion 10 of the skirt wall 6 by the unbroken, retained first high strength bridging portion 36*c*, is deformed into a shape arcuately extending from the site of presence of the first high strength bridging portion 6*c*. Thus, the flap pieces 28 are released from engagement with the engaging jaw portion 46 of the mouth-and-neck portion 42. Then, the entire container closure 2 including the tamper evident bottom portion 12 is moved upward in accordance with turning, whereby the entire container closure 2 is removed from the mouth-and-neck portion 42. During this unsealing procedure, the container closure 2 is somewhat raised, and the sealing liner 24 is separated from the top surface of the mouth-and-neck portion 42. At this time, the interior of the mouth-and-neck portion 42 is brought into communication with the outside through the gap between the top surface of the mouth-and-neck portion 42 and the sealing liner 24 and through the notches 20 (FIG. 1) formed in the internal thread 18 of the container closure 2.

During the foregoing unsealing operation, the first high strength bridging portion 36*d* may also be accidentally broken, whereupon the tamper evident bottom portion 12 is removed from the main portion 10 of the skirt wall 6. Thus, the parts of the container closure 2 other than the tamper evident bottom portion 12 are removed from the mouth-and-neck portion 42, while the tamper evident bottom portion 12 is left on the mouth-and-neck portion 42. On the other hand, the axial breakage means 34 formed in the tamper evident bottom portion 12 is constituted from the slit continuously extending from the upper end of the tamper evident bottom portion 12 substantially to its lower end. Thus, a cutting knife or the like is not necessary for cutting off the tamper evident bottom portion 12. If the thin-walled curl 32 is not broken along the extension of the slit, its breakage can result in the sufficiently easy removal of the remaining tamper evident bottom portion 12 from the mouth-and-neck portion 42.

Figure 5:
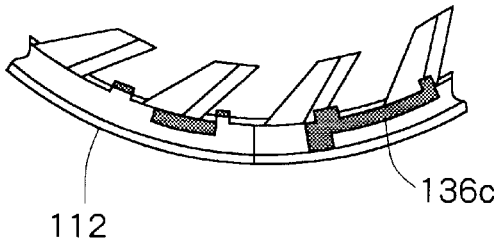
FIG. 5 is a partial cross-sectional view showing a modified example of a first high strength bridging portion.

FIG. 5 illustrates a modified example of a first high strength bridging portion. In this modified example illustrated in FIG. 5, a tamper evident bottom portion 112 is not cut at all in a left end part of a first high strength bridging is portion 136*c* in FIG. 5 in order to increase the sectional area of the first high strength bridging portion 136*c* and enhance its strength. In the left end part in FIG. 5, the first high strength bridging portion 136*c* exists in the entire thickness direction from the outer peripheral surface to the inner peripheral surface of the tamper evident bottom portion 112.

Figure 6:
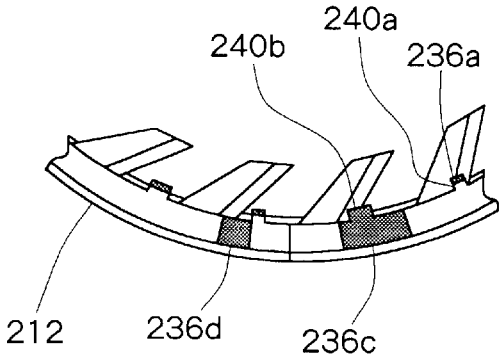
FIG. 6 is a partial cross-sectional view showing a modified example of a first high strength bridging portion and a second high strength bridging portion.

FIG. 6 illustrates a modified example of a first high strength bridging portion and a second high strength bridging portion. In the embodiment illustrated in FIG. 6, a tamper evident bottom portion 212 is not cut at all in the region of both a first high strength bridging portion 236*c* and a second high strength bridging portion 236*d*. Both of the first high strength bridging portion 236*c* and the second high strength bridging portion 236*d* are existent in their entire region in the circumferential direction throughout the thickness of the tamper evident bottom portion 112 from its outer peripheral surface to its inner peripheral surface. On the other hand, the circumferential lengths of the first high strength bridging portion 236*c* and the second high strength bridging portion 236*d* are smaller than the circumferential lengths of the first high strength bridging portion 36*c* and the second high strength bridging portion 36*d* illustrated in FIG. 2. One protrusion 240*b* defines the first high strength bridging portion 236*c*, while a protrusion 240*a* adjacent to, and located on the right of, the one protrusion 240*b* does not define a first high strength bridging portion 236*a*, but defines an ordinary bridging portion 236*a*.

Figure 7:
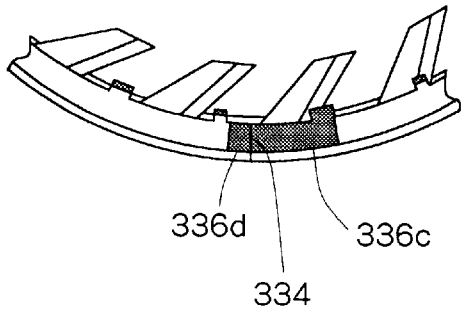
FIG. 7 is a partial cross-sectional view showing another modified example of a first high strength bridging portion and a second high strength bridging portion.

FIG. 7 illustrates another modified example of a first high strength bridging portion and a is second high strength bridging portion. In the embodiment illustrated in FIG. 7, a first high strength bridging portion 336*c* is not spaced from the upper end of a slit constituting an axial breakage means 334, but extends rightward in FIG. 7 from the upper end of the slit constituting the axial breakage means 334. Likewise, a second high strength bridging portion 336*d* is not positioned at a distance from the upper end of the slit constituting the axial breakage means 334, but extends leftward in FIG. 7 from the upper end of the slit constituting the axial breakage means 334. Thus, the first high strength bridging portion 336*c* and the second high strength bridging portion 336*d* are adjacent to each other via the slit.

Figure 8:
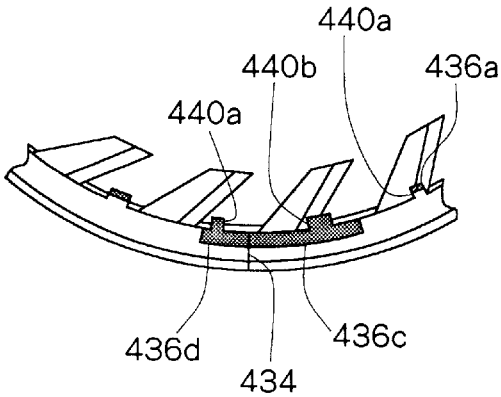
FIG. 8 is a partial cross-sectional view showing still another modified example of a first high strength bridging portion and a second high strength bridging portion.

FIG. 8 illustrates still another modified example of a first high strength bridging portion and a second high strength bridging portion. A first high strength bridging portion 436*c* in the embodiment illustrated in FIG. 8 is not spaced from the upper end of a slit constituting an axial breakage means 434, but extends rightward from the slit constituting the axial breakage means 434. One protrusion 440*b* defines the first high strength bridging portion 436*c*, while a protrusion 440*a* adjacent to, and located on the right of, this protrusion 440*b* does not define the first high strength bridging portion

436*c*, but defines an ordinary bridging portion 436*a*. In these respects, the first high strength bridging portion 436*c* in FIG. 8 is different from the first high strength bridging portion 36*c* in the embodiments illustrated in FIGS. 1 to 4. A second high strength bridging portion 436*d* in the embodiment illustrated in FIG. 8 is also different from the second high strength bridging portion 36*d* in the embodiments illustrated in FIGS. 1 to 4 in that the second high strength bridging portion 436*d* is not spaced from the upper end of the slit constituting the axial breakage means 434, but extends leftward from the slit constituting the axial breakage means 434; and that one protrusion 440*a* defines the second high strength bridging portion 436*d*.

Figure 9:
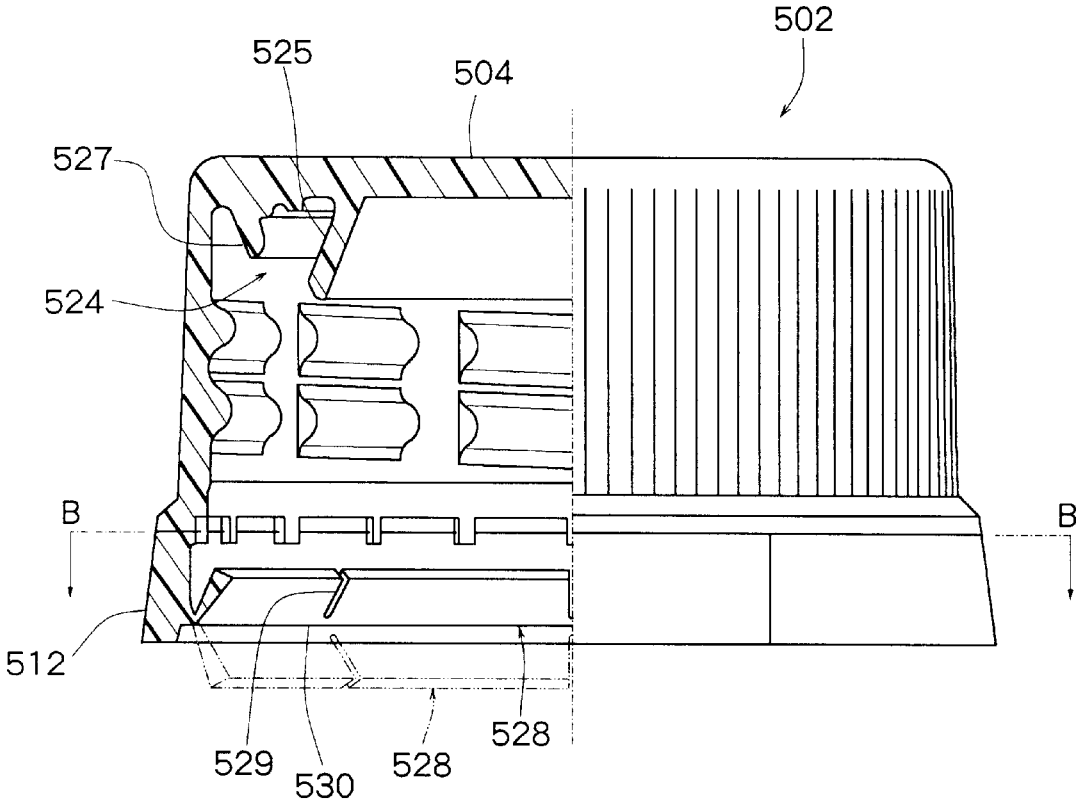
FIG. 9 is a partly sectional front view of another preferred embodiment of a container closure constructed in accordance with the present invention.
Figure 10:
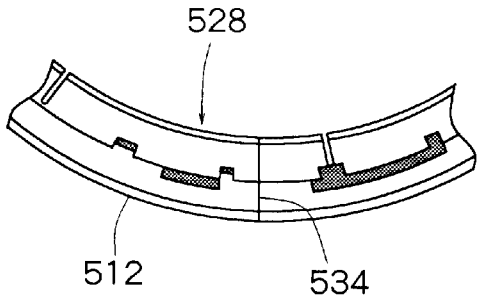
FIG. 10 is a partial cross-sectional view taken along line B—B of FIG. 9.

FIGS. 9 and 10 show another preferred embodiment of a container closure constructed in accordance with the present invention. In a container closure 502 illustrated in FIGS. 9 and 10, a sealing liner 524 is integrally formed on the inner surface of a top panel wall 504. The sealing liner 524 includes an inner annular sealing protrusion 525 which advances into a mouth-and-neck portion of a container until it is intimately contacted with the inner peripheral surface of the mouth-and-neck portion, and an outer annular sealing protrusion 527 which is intimately contacted with the upper surface or outer peripheral surface of the mouth-and-neck portion of the container. Engaging means disposed on the inner peripheral surface of a tamper evident bottom portion 512 is constituted from an annular protruding piece 528 extending continuously in the circumferential direction. The annular protruding piece 528 extends upwardly inclinedly in a radially inward direction from a base edge 530 connected to the inner peripheral surface of the tamper evident bottom portion 512. In the annular protruding piece 528, slits 529 extending from its front end to a site near the base edge are formed at circumferentially spaced positions. In molding the container closure 502 from a suitable plastic material, it is necessary to avoid severely forced mold release. For this purpose, it is advantageous to mold the annular protruding piece 528 in a shape extending downwardly in a radially inward direction as shown in a two-dot chain line in FIG. 9, and modify the shape into a condition indicated by a solid line after removal from the mold. In the embodiment in which the engaging means is composed of the annular protruding piece 528 continuously extending in the circumferential direction, as will be understood by reference to FIG. 10, it is preferred that a slit continuously extending from the base edge of the annular protruding piece 528 to its front end be formed in the annular protruding piece 528 in alignment with a slit constituting axial breakage means 534 in the tamper evident bottom portion 512. Such a slit in the annular protruding piece 528 can be formed advantageously by cutting the annular protruding piece 528 simultaneously with cutting the tamper evident bottom portion 512 with a cutting blade to form the slit constituting the axial breakage means 534. The constitution of the container closure 502 illustrated in FIGS. 9 and 10, other than the points mentioned above, is substantially the same as that of the container closure 2 illustrated in FIGS. 1 to 4. If desired, instead of the annular protruding piece 528 continuously extending in the circumferential direction (or the plurality of flap pieces 28 disposed at circumferentially spaced positions), engaging means of other suitable shape, such as a ratchet piece well known among people skilled in the art, may be disposed on the inner peripheral surface of the tamper evident bottom portion 512.

In the container closure of the present invention, the axial breakage means disposed in the tamper evident bottom portion is constituted from the slit continuously extending from the upper end of the tamper evident bottom portion substantially to its lower end. Thus, when the container closure is to be removed from the mouth-and-neck portion of the container, the bridging portions in the circumferential breakage means are broken, except for the one high strength bridging portion. As a result, the tamper evident bottom portion is necessarily spread in a band form, and the entire container closure is removed from the mouth-and-neck portion of the container. There may be a case in which all the bridging portions including the high strength bridging portion are broken, so that with the tamper evident bottom portion being left on the mouth-and-neck portion, the other portions of the container closure are removed from the mouth-and-neck portion. Even in this case, the tamper evident bottom portion remaining on the mouth-and-neck portion has the slit continuously extending from the upper end of the tamper evident bottom portion substantially to its lower end. Hence, the remaining tamper evident bottom portion can be removed from the mouth-and-neck portion sufficiently easily, without the need for a tiresome procedure, such as cutting the tamper evident bottom portion with a cutting tool. When the container closure is mounted on the mouth-and-neck portion of the container, on the other hand, the tamper evident bottom portion is fully inhibited, by the holding action of the first and second high strength bridging portions disposed on both sides of the axial breakage means, from being enlarged at the site where its axial breakage means exists. Thus, breakage of at least some of the plurality of bridging portions in the circumferential breakage means is prevented fully reliably.

I claim:

1. A plastic container closure having tamper evident properties which is to be applied to a container having a mouth-and-neck portion on whose outer peripheral surface an external thread and an engaging jaw portion positioned below the external thread are formed, said plastic container closure having a top panel wall and a skirt wall extending downwardly from the top panel wall; said skirt wall having formed therein a circumferentially extending circumferential breakage means, said skirt wall being divided into a main portion above the circumferential breakage means, and a tamper evident bottom portion below the circumferential breakage means; said main portion of said skirt wall having formed on its inner peripheral surface an internal thread collaborating with the external thread of the mouth-and-neck portion; said tamper evident bottom portion having formed on its inner peripheral surface an engaging means collaborating with the engaging jaw portion of the mouth-and-neck portion; said circumferential breakage means including a plurality of bridging portions disposed at circumferentially spaced positions and connecting the tamper evident bottom portion to the main portion of the skirt wall; one of said bridging portions being a first high strength bridging portion having a large cross-sectional area; and said tamper evident bottom portion having disposed therein an axial breakage means; wherein the axial breakage means is constituted from a slit continuously extending from the upper end of the tamper evident bottom portion substantially to its lower end; the plurality of bridging portions include a second high strength bridging portion having a large cross-sectional area in addition to the first high strength bridging portion; the first high strength bridging portion and the second high strength bridging portion are disposed on both sides of the axial breakage means when viewed in the circumferential direction; and the first high strength bridging portion extends in one circumferential direction from the upper end, or one end close thereto, of the axial breakage means, while the second high strength bridging portion extends in the opposite circumferential direction from the upper end, or one end close thereto, of the axial breakage means;

the internal thread is screwed onto the external thread and the engaging means is engaged with the engaging jaw portion, whereby the plastic container closure is mounted on the mouth-and-neck portion; and when the screwing together of the internal thread and the external thread is released to remove the plastic container closure from the mouth-and-neck portion, at least one of the first high strength bridging portion and the second high strength bridging portion is broken.

2. The plastic container closure as claimed in, claim 1 wherein the tamper evident bottom portion is provided with a thin-walled curl extending from the lower end thereof, and the slit constituting the axial breakage means extends only partly, or does not extend at all, to the thin-walled curl.

3. The plastic container closure as claimed in, claim 1 wherein the one end of the first high strength bridging portion and the one end of the second high strength bridging portion are positioned at a distance of 1.00 to 3.00 mm from the upper end of the axial breakage means.

4. The plastic container closure as claimed in claim 3, wherein the tamper evident bottom portion is provided with a thin-walled curl extending from the lower end thereof, and the slit constituting the axial breakage means extends only partly, or does not extend at all, to the thin-walled curl.

5. The plastic container closure as claimed in claim 1, wherein the cross-sectional area of the first high strength bridging portion is larger than the cross-sectional area of the second high strength bridging portion, and when the screwing together of the internal thread and the external thread is released to remove the plastic container closure from the mouth-and-neck portion, the second high strength bridging portion is broken, while the first high strength bridging portion remains unbroken, the tamper evident bottom portion is spread in a band form with the engaging means being disengaged from the engaging jaw portion, and the entire container closure including the tamper evident bottom portion is removed from the mouth-and-neck portion.

6. The plastic container closure as claimed in claim 5, wherein the one end of the first high strength bridging portion and the one end of the second high strength bridging portion are positioned at a distance of 1.00 to 3.00 mm from the upper end of the axial breakage means.

7. The plastic container closure as claimed in claim 5, wherein the tamper evident bottom portion is provided with a thin-walled curl extending from the lower end thereof, and the slit constituting the axial breakage means extends only partly, or does not extend at all, to the thin-walled curl.

8. The plastic container closure as claimed in claim 5, wherein when viewed in a direction in which the container closure is turned for releasing the screwing together of the internal thread and the external thread to remove the container closure from the mouth-and-neck portion, the first high strength bridging portion is located ahead of the axial breakage means, while the second high strength bridging portion is located behind-the axial breakage means.

9. The plastic container closure as claimed in claim 8, wherein the one end of the first high strength bridging portion and the one end of the second high strength bridging portion are positioned at a distance of 1.00 to 3.00 mm from the upper end of the axial breakage means.

10. The plastic container closure as claimed in claim 8, wherein the tamper evident bottom portion is provided with a thin-walled curl extending from the lower end thereof, and the slit constituting the axial breakage means extends only partly, or does not extend at all, to the thin-walled curl.

11. The plastic container closure as claimed in claim 5, wherein the cross-sectional area of the first high strength bridging portion is 1.50 to 4.50 $mm^2$, while the cross-sectional area of the second high strength bridging portion is 0.80 to 2.20 $mm^2$.

12. The plastic container closure as claimed in claim 11, wherein when viewed in a direction in which the container closure is turned for releasing the screwing together of the internal thread and the external thread to remove the container closure from the mouth-and-neck portion, the first high strength bridging portion is located ahead of the axial breakage means, while the second high strength bridging portion is located behind the axial breakage means.

13. The plastic container closure as claimed in claim 11, wherein the one end of the first high strength bridging portion and the one end of the second high strength bridging portion are positioned at a distance of 1.00 to 3.00 mm from the upper end of the axial breakage means.

14. The plastic container closure as claimed in claim 11, wherein the tamper evident bottom portion is provided with a thin-walled curl extending from the lower end thereof, and the slit constituting the axial breakage means extends only partly, or does not extend at all, to the thin-walled curl.

* * * * *